US008672600B2

(12) United States Patent
Reznar et al.

(10) Patent No.: US 8,672,600 B2
(45) Date of Patent: Mar. 18, 2014

(54) DECK CLIP

(75) Inventors: Jason Reznar, Redford, MI (US); Robert Dziadula, Northville, MI (US); Robert Taylor, Jr., South Lyon, MI (US)

(73) Assignee: Tinnerman Palnut Engineered Products, Inc., Brunswick, OH (US)

( * ) Notice: Subject to any disclaimer, the term of this patent is extended or adjusted under 35 U.S.C. 154(b) by 650 days.

(21) Appl. No.: 12/322,913

(22) Filed: Feb. 9, 2009

(65) Prior Publication Data

US 2009/0223027 A1 Sep. 10, 2009

Related U.S. Application Data

(60) Provisional application No. 61/063,909, filed on Feb. 7, 2008.

(51) Int. Cl.
*E04B 1/38* (2006.01)
*F16B 15/00* (2006.01)
*F16B 15/06* (2006.01)

(52) U.S. Cl.
USPC ..... 411/457; 411/466; 52/489.1; 52/702; 52/704; 52/714

(58) Field of Classification Search
USPC ..... 24/293–295, 457, 545; 411/457, 461, 411/466, 477, 478, 921, 520, 522; 403/232.1–234, 403; 52/480, 489.1, 52/489.2, 702, 704, 712, 714
See application file for complete search history.

(56) References Cited

U.S. PATENT DOCUMENTS

| | | | | | |
|---|---|---|---|---|---|
| 483,040 | A | * | 9/1892 | Binet | 217/67 |
| 546,147 | A | * | 9/1895 | Gregg | 403/232.1 |
| 778,809 | A | * | 12/1904 | Stokes | 411/467 |
| 831,179 | A | * | 9/1906 | McDonagh | 16/4 |
| 1,089,878 | A | * | 3/1914 | Steinhauser | 411/466 |
| 1,095,119 | A | * | 4/1914 | Krum | 411/466 |
| 1,531,916 | A | * | 3/1925 | Flintjer | 403/276 |
| 1,947,388 | A | * | 2/1934 | Frey | 52/703 |
| 2,197,750 | A | * | 4/1940 | Lagaard | 411/461 |
| 2,208,848 | A | * | 7/1940 | Jorgensen | 411/459 |
| 2,282,624 | A | * | 5/1942 | Upson et al. | 411/466 |

(Continued)

FOREIGN PATENT DOCUMENTS

WO 96/18776 6/1996

OTHER PUBLICATIONS

Int'l Search Report, Mar. 30, 2009, Tinnerman Palnut.

(Continued)

*Primary Examiner* — Victor Batson
*Assistant Examiner* — Tyler Johnson
(74) *Attorney, Agent, or Firm* — McDonald Hopkins LLC

(57) ABSTRACT

The present invention provides a clip having a general T-shape. The clip may be mounted to a deck board structure for engagement with a joist. The clip may include a base for mounting to a structure, such as a deck board, and barbs located on the base. The clip may also include a pair of supporting arms having clamping tabs with barbs. The barbs of the base and the clamping tabs may grip onto a joist. The clip may also include an aperture that is capable of connecting the base to the deck board. Once assembled with the deck board and joist, the clip may remain completely hidden from view after deck completion.

20 Claims, 6 Drawing Sheets

(56) References Cited

U.S. PATENT DOCUMENTS

| | | | | | |
|---|---|---|---|---|---|
| 2,339,841 | A | * | 1/1944 | Deuchler et al. | 52/489.2 |
| 2,379,179 | A | * | 6/1945 | Petersen | 52/282.1 |
| 2,742,778 | A | * | 4/1956 | Olmstead | 52/713 |
| 3,020,602 | A | | 2/1962 | Siering | |
| 3,049,042 | A | * | 8/1962 | De Lynn | 411/446 |
| 3,208,119 | A | * | 9/1965 | Seckerson | 52/716.6 |
| 3,298,151 | A | * | 1/1967 | Jureit | 52/644 |
| 3,310,324 | A | * | 3/1967 | Boden | 403/217 |
| 3,447,823 | A | * | 6/1969 | Gregoire | 52/714 |
| 3,601,428 | A | * | 8/1971 | Gilb | 403/232.1 |
| 3,703,304 | A | * | 11/1972 | Losee | 411/462 |
| 3,809,358 | A | | 5/1974 | Hazeley | |
| 3,881,293 | A | * | 5/1975 | Conville | 52/712 |
| 4,033,083 | A | | 7/1977 | Fritz et al. | |
| 4,198,175 | A | * | 4/1980 | Knepp et al. | 403/191 |
| 4,490,893 | A | * | 1/1985 | Muller et al. | 24/704.1 |
| 4,525,971 | A | | 7/1985 | Kern | |
| 4,616,950 | A | * | 10/1986 | Morris | 403/231 |
| 4,630,338 | A | * | 12/1986 | Osterland et al. | 24/293 |
| 4,641,474 | A | * | 2/1987 | Cannarsa | 52/514 |
| 4,644,612 | A | * | 2/1987 | Osterland | 24/295 |
| 4,910,934 | A | * | 3/1990 | Hennings | 52/714 |
| 4,926,606 | A | * | 5/1990 | Hanson | 52/506.07 |
| 4,965,980 | A | | 10/1990 | Leavens | |
| 5,027,573 | A | | 7/1991 | Commins et al. | |
| 5,307,603 | A | | 5/1994 | Chiodo | |
| 5,564,248 | A | * | 10/1996 | Callies | 52/702 |
| 5,678,379 | A | * | 10/1997 | Quattrociocchi | 52/712 |
| 5,774,949 | A | * | 7/1998 | Cornell et al. | 24/293 |
| 5,997,209 | A | | 12/1999 | Sachs | |
| 6,148,579 | A | * | 11/2000 | Rolf | 52/639 |
| 6,317,937 | B1 | * | 11/2001 | Ishihara et al. | 24/297 |
| 6,341,466 | B1 | * | 1/2002 | Kehoe et al. | 52/712 |
| 6,416,269 | B1 | | 7/2002 | Martel et al. | |
| 6,499,782 | B2 | * | 12/2002 | Kwon | 296/1.02 |
| 6,691,380 | B2 | * | 2/2004 | Vassiliou | 24/295 |
| 6,792,733 | B2 | | 9/2004 | Wheeler et al. | |
| 6,840,020 | B2 | * | 1/2005 | Leek et al. | 52/712 |
| 6,871,467 | B2 | | 3/2005 | Hafner | |
| 7,021,879 | B2 | * | 4/2006 | Taneichi | 411/466 |
| 7,251,918 | B2 | | 8/2007 | Reif et al. | |
| 7,971,410 | B2 | * | 7/2011 | Jerke | 52/702 |
| 2002/0007537 | A1 | * | 1/2002 | Lubera et al. | 24/293 |
| 2002/0112438 | A1 | * | 8/2002 | Little | 52/702 |
| 2007/0294979 | A1 | * | 12/2007 | Lin et al. | 52/702 |

OTHER PUBLICATIONS

Supplementary European Search Report, A. Raymond Et Cie, Mar. 8, 2011.

International Preliminary Report on Patentability, A. Raymond et Cie, Aug. 10, 2010.

* cited by examiner

DECK CLIP

CROSS-REFERENCE TO RELATED APPLICATION

This application claims benefit from U.S. Provisional Patent Application No. 61/063,909, entitled "Deck Clip," filed on Feb. 7, 2008, which is hereby incorporated in its entirety by reference.

FIELD OF THE INVENTION

The present invention relates generally to fasteners, and more particularly to fasteners for securing structural building members together.

BACKGROUND OF THE INVENTION

Wooden structures, such as decks or fences, typically comprise two or more wooden joists spanned by a plurality of parallel boards. These boards are nailed to the joists and are typically constructed by driving nails down through the exposed face surface of the boards into the joists. This method is undesirable for several reasons. With hammering, it is easy to miss and hit the board, thus denting or marring it. Box head nails may hold well, but can remain visible and detract from the aesthetic appearance of the deck, fence or other wooden structure. In addition, the nail head will often discolor the area around it and the wooden board. While finish nails may not be as displeasing in appearance as box head nails, they typically take longer to install and retain water in the hole, which often leads to rot and rust. Also, nails can work upwards and out such that the nail head may be located above the board surface thereby causing a safety hazard. In addition, water typically gets into the crack between the board and joist and often causes rot.

One alternative, which produces a more aesthetic surface appearance, is to drill countersink a screw and to plug the remaining hole above the screw with a small piece of wood. However, this method is expensive and time consuming. In addition, the plugs typically work there way out in time, and the remaining holes fill with water.

Another alternative is to provide a bracket between a pair of deck boards whereby the bracket is secured to the top of a joist while also being affixed to the sides of the deck boards. This method, however, involves more labor than the previous methods, requires a great number of brackets and fasteners, and further requires specialized tools to assist in the bracket installation. Moreover, the brackets remain visible after completion because the brackets span the space between the deck boards.

Therefore, there exists a need in the art for an attachment device that is easy to install, efficient, whereby fewer fasteners are required, and is hidden once deck construction is complete.

DESCRIPTION OF THE DRAWINGS

Objects and advantages together with the operation of the invention may be better understood by reference to the following detailed description taken in connection with the following illustrations, wherein like numerals indicate like elements throughout, and wherein.

SUMMARY OF THE INVENTION

A clip for connecting first and second intersecting members. The clip may include a base having a planar configuration and defining an inner surface and an outer surface. The base may also include at least one attachment feature associated with the base and capable of attaching the base to the first member. The base may further include at least one barb extending downwardly from the inner surface of the base and capable of connection with the second member. The clip may also include a pair of mutually confronting arms extending downwardly from the inner surface of the base. Each arm may include a clamping tab extending at an angle from the arm and at least one barb extending from the clamping tab that is capable of connection with the second member.

DETAILED DESCRIPTION

While the present clip is described with reference to an illustrative embodiment described herein, it should be clear that the present invention should not be limited to such an embodiment. Therefore, the description of the embodiment provided herein is illustrative of the present invention and should not limit the scope of the invention as claimed.

Moreover, while the present clip is described in the context of deck construction, it will be appreciated that the clip may be used in a variety of construction contexts, and, as such, any reference to deck construction is illustrative in nature and not restrictive in any way. In addition, the description of the embodiment provided may refer to a specific orientation of the clip, such as in a downward direction, however, this should not limit the scope of the invention as claimed. Those skilled in the art will understand that the clip may be positioned or attached to any number of surfaces and placed in any number of various orientations and directions and the following descriptions should only be taken as illustrative.

As generally described herein and with reference to FIGS. 1-10, the present invention provides a clip 10, preferably a T-shaped clip or a deck clip. The fasteners of current deck assemblies are not completely hidden from the customer after deck completion. In addition, current fasteners require a high amount of labor to be involved during the installation process, a high quantity of components are required to be utilized, and specialized tools are needed to install the fasteners. Unlike the prior art, the present clip 10 may easily snap into place without the need for specialized tools, requires fewer components and less time for assembly, and remains hidden from the customer after deck completion.

The clip 10 may combine the function of typical prior art fasteners into an easy to use and assemble one-piece component or one-piece stamping. This combination eliminates the need for multiple components, as well as eliminates the need for any complicated assembly tools, which both result in cost savings, while also speeding up assembly time.

Figure 6:
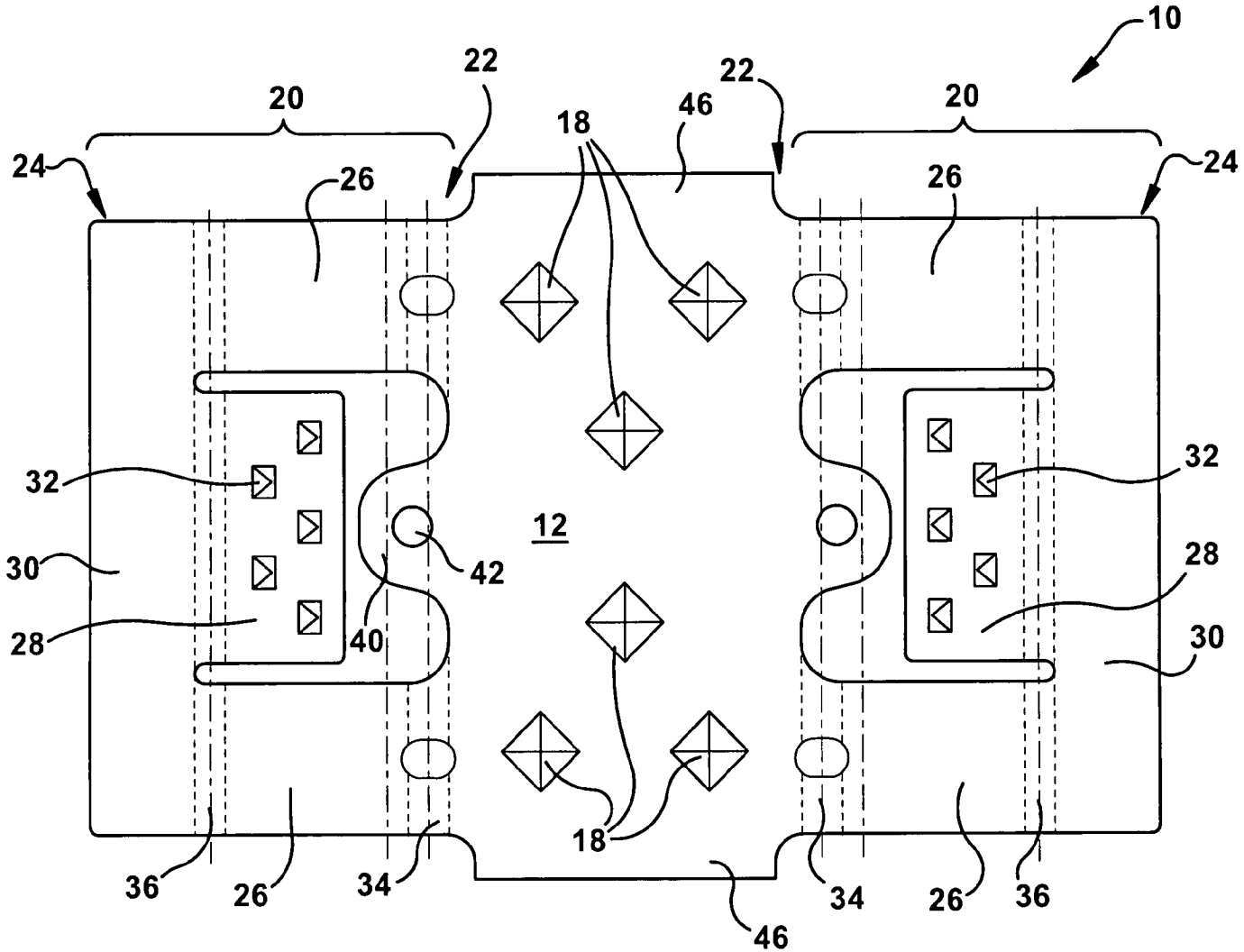
FIG. 6 is a top view of the clip in an unformed state.

The clip 10 may be constructed from any suitable and appropriate material, including but not limited to metal, polymer, composite, etc. Preferably, however, the clip 10 may be constructed from a heat treated 1050-1065 steel. It is to be understood that the clip 10 may be of any appropriate size, shape, size, and thickness. Preferably, the clip 10 may be approximately 1.02 mm thick and of a generally rectangular shape when in its unformed state, as shown in FIG. 6.

With reference to FIGS. 1-6, the clip 10 may include a base 12 and a pair of supporting arms 20. Thus, the clip 10 may require two supporting arms 20 and the base 12 to be complete. The pair of arms 20 are preferably of a similar structure and are preferably a substantially mirror image of one another. It is to be understood, however, that the arms 20 may be of the same or of a different shape and structure and do not have to be a substantially mirror image of one another. Since the arms 20 are similar, the following description of the support arm 20 will be understood to apply to both arms 20 needed for the clip 10.

The arms 20 may be integrally formed with the base 12. As an alternative, instead of being an integrally formed one piece clip 10, the base 12 and the pair of arms 20 may be separate pieces that may be secured to one another by any appropriate means, including but not limited to welding, adhesive, mechanical fasteners, etc. and the like.

In use, and for illustrative purposes only, the deck clip 10 may be attached to the underside U of a deck board B. After attachment to the deck board B, the clip 10 may be attached or snapped onto the top T of a joist J. This example will be discussed in greater detail below.

The base 12 may include an inner surface 14 and an outer surface 16. The base 12 may serve as a mounting structure. The outer surface 16 may abut the underside U of a deck board B, for example. The base 12 may also include at least one base barb 18. The base barbs 18 may project outwardly from the inner surface 14 of the base 12. It is to be understood that any appropriate and suitable number of base barbs 18 may be utilized, however, there are preferably six base barbs 18. The base barbs 18 may also be of any appropriate size or shape, but are preferably of a generally square shape, as shown in FIGS. 1,2,4 and 6.

The base barbs 18 may have any suitable configuration capable of securing the clip 10 to the top T of a joist J. For example, the base barbs 18 may have suitably sharp ends such that the barbs 18 may be driven into the top T of a joist J, thereby acting like a nail. Other suitable base barb 18 configurations will be apparent to those skilled in the art. The base barbs 18 may be integrally formed with the base plate 2, such as projections that are formed in or on the base plate 12, or they may be separate pieces that are secured to the inner surface 14 of the base plate 12 by any appropriate means, including but not limited to fasteners, adhesive, welding, etc., or the like.

Figure 1:
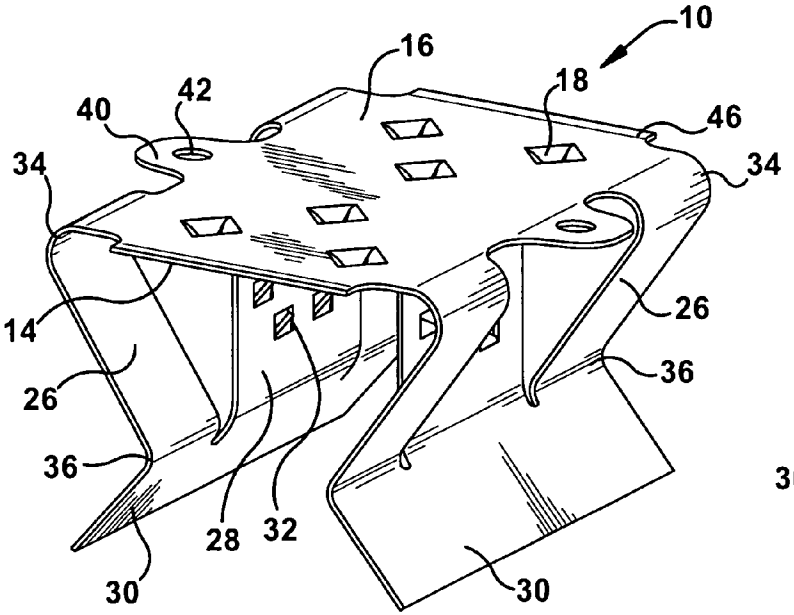
FIG. 1 is a perspective view of an embodiment of a clip as seen from the top, front and left side of the clip.
Figure 2:
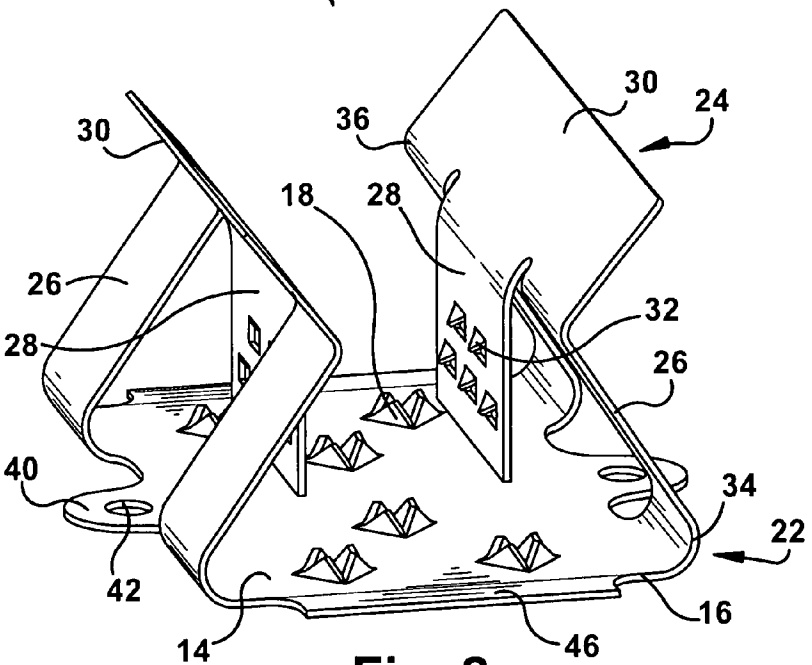
FIG. 2 is another perspective view of the clip as seen from the bottom, front and right side of the clip.
Figure 5:
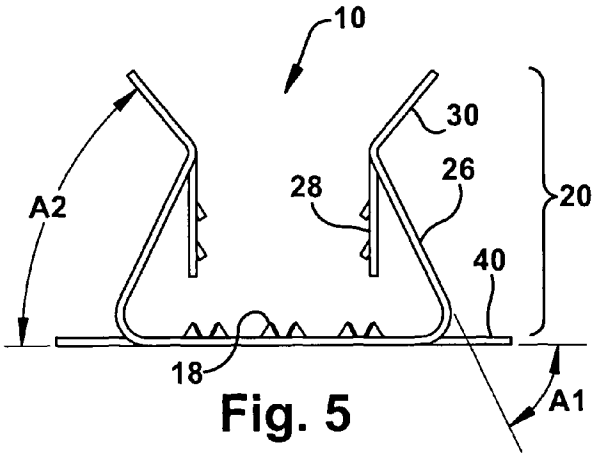
FIG. 5 is a side view of the clip.
Figure 3:
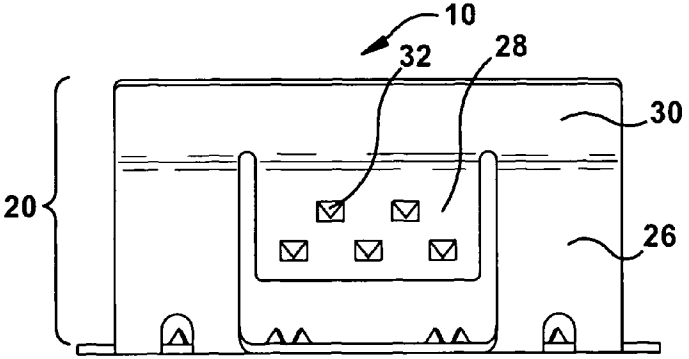
FIG. 3 is a front view of the clip.
Figure 4:
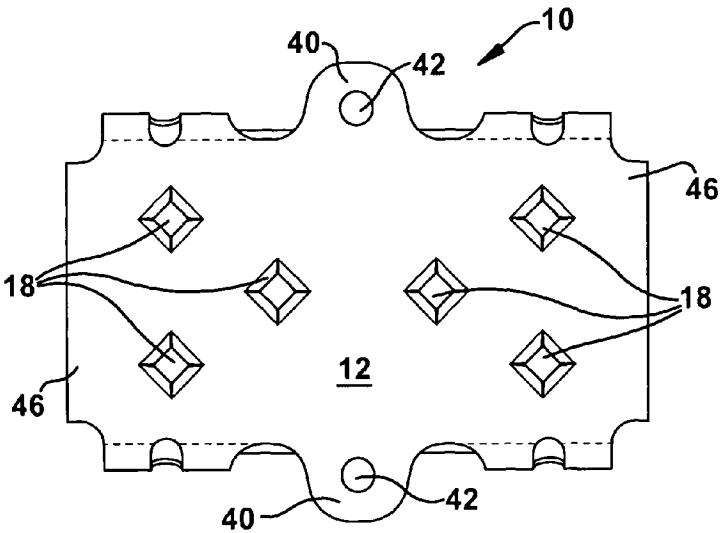
FIG. 4 is a top view of the clip.

With reference to FIGS. 1, 2 and 4, the base 12 may include an attachment feature or tab 40. The attachment tab 40 may include an aperture 42. The aperture 42 may be of any appropriate shape or size, but is preferably of a generally circular shape. In addition, there may be any number of appropriate apertures 42, but there is preferably one aperture 42 located in the tab 40. In addition, the clip 10 may have any appropriate number of attachment tabs 40, but there are preferably two attachment tabs 40. The attachment tabs may be located at any appropriate location, but are preferably located around the approximate center of either side of the base 12, as well as being located approximately opposite of one another. It is to be understood, that the attachment feature or tab 40 is not limited to being a tab and may be located any where within or on said base 12.

Figure 7:
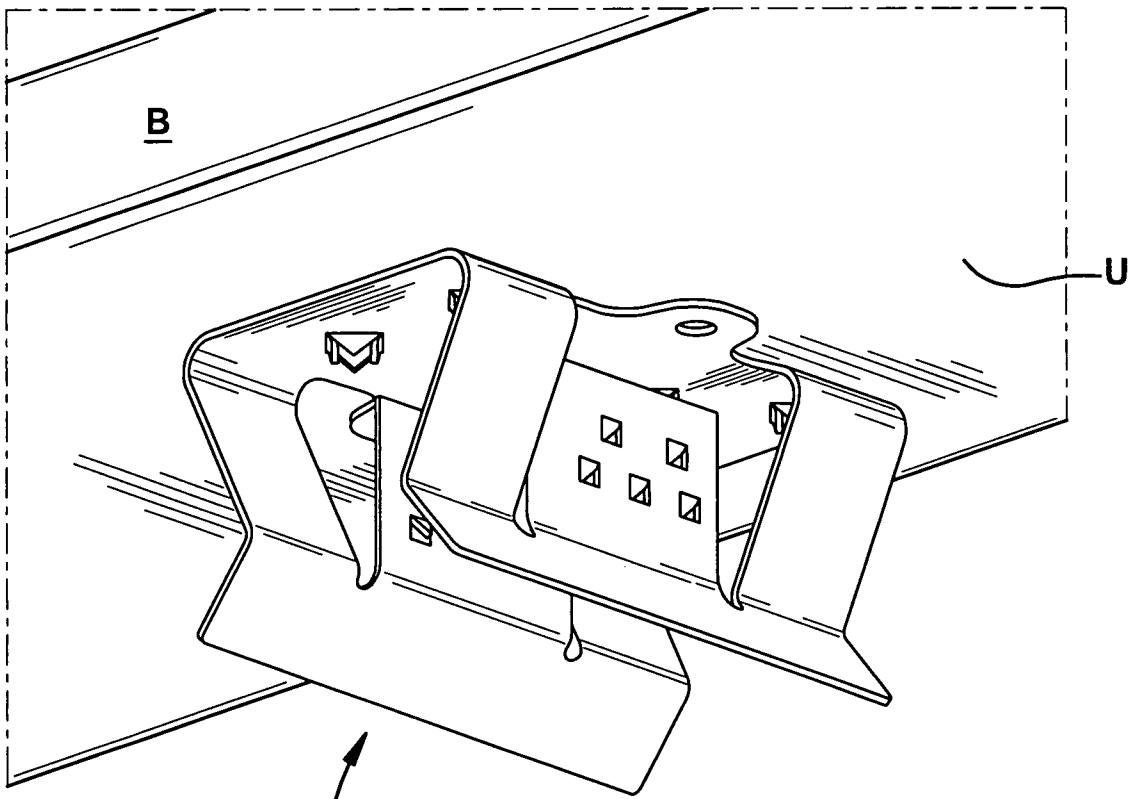
FIG. 7 is an environmental perspective view of the clip in place with a deck board.

The aperture 42 of the attachment tabs 40 may be operable to receive a fastener (not shown) and thereby secure the clip 10 to the underside U of a deck board B, as best shown in FIG. 7. Alternatively, the attachment tabs 40 may be secured to the deck board B by any other appropriate means, such as by welding, adhesive, etc, or the like. In yet another alternative, the base plate 12 may not include any attachment tabs 40. In such an embodiment, the outer surface 16 of the base plate 12 may be secured to the underside U of a deck board B via fastener(s), welding, adhesive, etc., or the like. In addition, the attachment tabs 40 may be integrally formed with the base plate 12 or may be separate pieces that may be secured to the base plate 12 by any suitable measure, including, but not limited to fastener(s), adhesive, welding, etc., or the like.

The base 12 may also include a pair of alignment tabs 46. The alignment tabs 46 may be located at opposite ends of the base 12, as shown in FIGS. 1-2 and 4. It is to be understood, however, that the alignment tabs 46 may be positioned at any other appropriate location on the clip 10. The tabs may be used for lining up with pencil marks from the joist J or to be used to line up with the joists J.

With additional reference to FIGS. 1, 2 and 6, each support arm 20 may include at least one outer structural member 26, an inner clamping tab 28, and a wing 30. The arms 10 may also include a proximal end 22 and a distal end 24. The proximal end 22 may be located near the base 12. The distal end may be located near the wing 30. Preferably, there are two outer structural members 26, but it is to be understood that any appropriate number of structural members may be used. The outer structural members 26 may be of any appropriate size or shape, but are preferably of a generally rectangular shape. In addition, the arms 20 may extend in a generally outward direction from the base 12.

The wings 30 may be integrally connected to and formed with the outer structural members 26 and the inner clamping tab 28. The wing 30 may preferably be connected to the outer structural members 26 and the inner clamping tab 28 near the distal end 24 of the supporting arm 20. The wings 30 may be of any appropriate size or shape, but are preferably of a generally rectangular shape. The inner clamping tabs 28 may be of any appropriate size or shape, but are preferably of a generally rectangular shape.

The supporting arms 20 may be integrally formed with the base plate 12 or may be separate pieces that are secured to the base plate 12 by any appropriate means, including, but not limited to, fastener(s), adhesive, welding, etc., and the like. Alternatively, the supporting arms 20 may comprise a single segment that may substantially span the entire length of the base plate 12 instead of having the outer structural members 26, inner clamping tab 28 and wing 30.

The inner clamping tab 28 may be located between the outer structural members 26, as shown in FIGS. 1-3 and 6. The inner clamping tab 28 may be positioned substantially perpendicular to the base 12 such that the inner clamping tab 28 may be substantially parallel with the corresponding barb plate 28 of the opposite supporting arm 20. Therefore, the inner clamping tabs 28 may be spaced apart an appropriate distance so as to receive a joist J therebetween and, thus, secure the joist J to the clip 10. The inner claming tabs 28 may also be of any appropriate shape or size, but is preferably of a generally rectangular shape.

The inner clamping tabs 28 may be integrally formed with the supporting arms 20, or may be a separate piece that may be secured to the supporting arm 20 by any suitable measure, including, but not limited to, fastener(s), adhesive, welding, etc., and the like. Alternatively, the inner clamping tab 28 may extend from the inner surface 14 of the base plate 12 and be integrally formed with the base plate 12 or a separate piece that may be secured to the base plate 12 by any suitable measure, including, but not limited to, fastener(s), adhesive, welding, etc., and the like.

With reference to FIGS. 1-3 and 6, the inner clamping tab 28 may include at least one tab barb 32. The tab barbs 32 may project outwardly from the inner clamping tab 28 of the supporting arms 20. It is to be understood that any appropriate and suitable number of tab barbs 32 may be utilized, however, there are preferably five tab barbs 32. The tab barbs 32 may also be of any appropriate size or shape. The tab barbs 32 may have any suitable configuration to secure the clip 10 to the side S of a joist J.

As stated above, a pair of supporting arms 20 may extend from the base plate 12. With reference to FIGS. 1, 2, 5 and 6, there may be a first bend 34 located between the base 12 and the outer structural member 26 near the proximal end 22 of the supporting arm 20. The outer structural member 26 of the supporting arm 20 may be located adjacent to and preferably at an angle A1 away from the base 12, due to the first bend 34. The angle A1 of the first bend 34 may be of any appropriate degree, but is preferably an approximately 62.5-degree angle A1, as may be best shown in FIG. 5.

With further reference to FIGS. 1, 2, 5 and 6, there may be a second bend 36 located between the outer structural member 26 near the distal end 24 of the arm 20 and the wing 30. The wing 30 may be located adjacent to and preferably at an angle A2 away from the outer structural member 26 of the supporting arm 20, due to the second bend 36. The angle A2 of the second bend 36 may be of any appropriate degree, but is preferably an approximately 47.5 degree angle A2 located between the base 12 and the wing 30, as may be best shown in FIG. 5.

In the preferred embodiment, the tab barbs 32 may be angled towards the base 12 such that a joist J may enter between the inner clamping tabs 28 and be urged towards the base 12. However, if the joist J is urged away from the base 12, the tab barbs 32 may be driven: into the respective sides S of the joist J to maintain the joist J between the inner clamping tabs 28. Other suitable tab barb 32 configurations will be apparent to those skilled in the art. The tab barbs 32 may be integrally formed with the inner clamping tab 28, such as projections that are formed in or on the inner clamping tab 28 or they may be separate pieces that may be secured to the surface of the inner clamping tab 28. The tab barbs 32 may be secured to the inner clamping tabs 28 by any suitable measure, including, but not limited to, fasteners, adhesive, welding, etc., or the like.

As shown in FIG. 6, the wings 30 may preferably be angled away from the inner surface 14 of the base plate 12. This angling of the wings 30 of the clip 10 may allow for an overall one-half inch tolerance for build variation or warped joints J. However, as discussed above, it will be appreciated that the wing 30 may be at any suitable angle relative to the base plate 12.

For illustrative purposes only, and with reference to FIGS. 7-10, the clip 10 may first be affixed to the underside U of a deck board B by driving a fastener (not shown), such as a nail, screw, or the like, through the aperture 42 in each attachment tab 40, and thus into the underside U of the deck board B. Typically, as is known in the art, a plurality of clips 10 may be affixed to the undersides U of the deck boards B in a spaced relationship to one another such that the deck board B may be secured to a plurality of joists J. For the sake of simplicity, however, the following description will reference only one such deck clip 10 and one such joist J. Nevertheless, it will be appreciated that any number of clips 10 may be affixed to the underside U of a deck board B in order to secure the deck board B to any number of joists J and still remain within the scope of the present invention.

Figure 8:
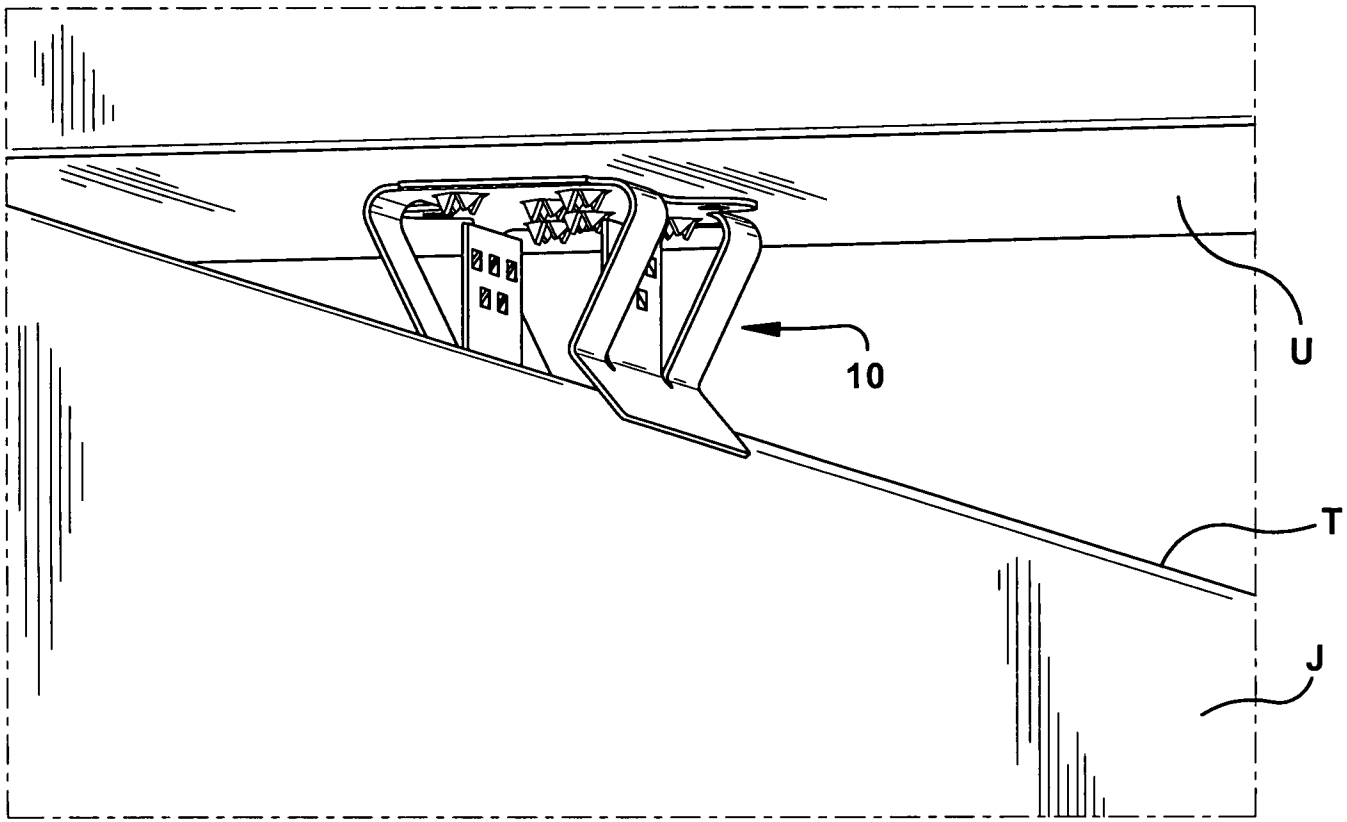
FIG. 8 is another environmental perspective view of the clip prior to assembly with a joist.
Figure 10:
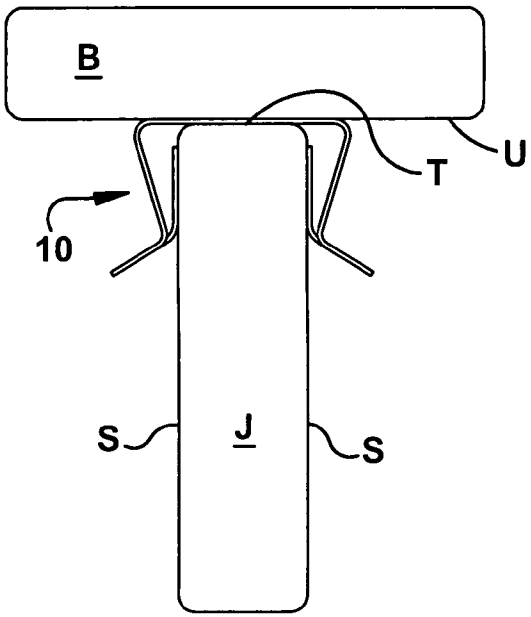
FIG. 10 is cross-sectional view of the clip assembled to a deck board and joist.
Figure 9:
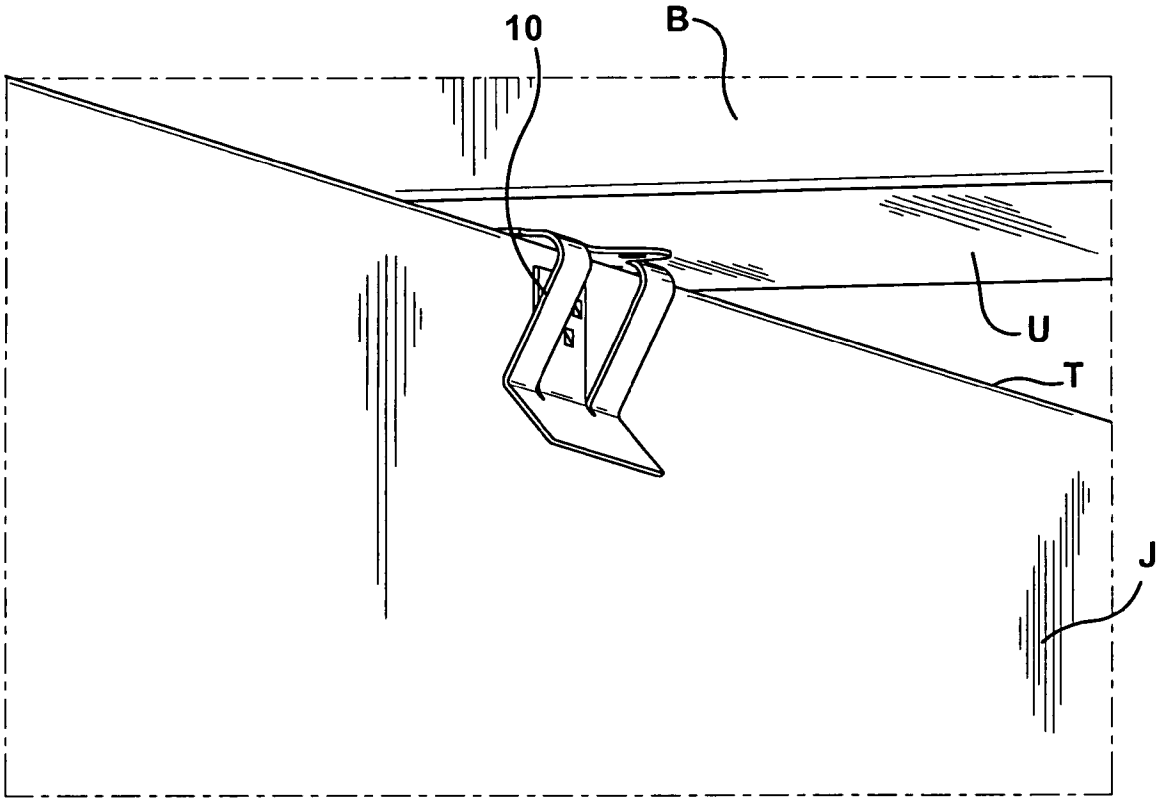
FIG. 9 is another environmental perspective view of the clip assembled with a deck board and joist.

Once the clips 10 have been securely affixed to the deck board B, the deck board B may be flipped over to mate the clips 10 with the joists J. The clips 10 may be centered with the joists J and all affixed to the bottom of a deck board B before the board B is flipped over and placed onto the joists J. As shown in FIGS. 8-10, the deck board B may be placed atop the joist J such that the joist J may be positioned between the inner clamping tabs 28 of the arms 20 of the clip 10 and the inner surface 14 of the base 12.

Once in place, an appropriate amount of force may be applied to the top of the deck board B such that the clip 10 may be forced further down onto the joist J into the clips 10 final position. Force may be applied to the top of the deck board B by any suitable amount or measure, including, but not limited to, a hammer, a mallet, a person stepping onto or pushing against the board B, etc., and the like. As force is applied to the top of the deck board B, the joist J may be forced further into the space between the pair of supporting arms 20 such that the inner clamping tabs 28 may engage the respective sides S of the joist J. As the inner clamping tabs 28 engage the joist J, the tab barbs 32 secure themselves into the sides S of the joist J, thereby preventing the joist J from disengaging the clip 10. Additionally, the top T of the joist J will ultimately abut the inner surface 14 of the base plate 12 such that the base barbs 18 will be driven into the top T of the joist J, thus further securing the deck board B to the joist J. The base barbs 18 may act to "bite" and secure themselves into the top T of the joist J. The base barbs 18 secured into the top T of the joist J and the tab barbs 32 secured to the sides S of the joists J, along with the compression of the clip 10 is what retains the deck board B to the joists J.

The invention has been described above and, obviously, modifications and alterations will occur to others upon a reading and understanding of this specification. The claims as follows are intended to include all modifications and alterations insofar as they come within the scope of the claim or the equivalents thereof.

Having thus described the invention, we claim:

1. A T-clip for connecting first and second intersecting members, said T-clip comprising:

a base having a planar configuration and defining an inner surface and an outer surface, wherein said base is configured to engage a planar surface of the first member;

at least one attachment feature associated with said base and capable of attaching said base to the first member;

at least one barb extending downwardly from said inner surface and capable of piercing the second member; and a pair of mutually confronting arms extending downwardly from said inner surface, each arm comprising:

a clamping tab extending at an angle from said arm, wherein said clamping tab is generally perpendicular to said base; and a plurality of barbs extending from said clamping tab and capable of connection with the second member.

2. The T-clip of claim 1, wherein said base and said arms are integrally formed as one piece.

3. The T-clip of claim 2, wherein said attachment feature includes an aperture capable of receiving a fastener.

4. The T-clip of claim 2, wherein said at least one barb includes a plurality of bards extending downwardly from said inner surface and configured to pierce the second member.

5. The T-clip of claim 1, wherein said arms extend at an acute angle relative to said base.

6. The T-clip of claim 2, wherein said base includes at least one alignment tab.

7. The T-clip of claim 2, wherein said at least one clamping tab includes a pair of clamping tabs whereby each arm includes one of said pair of clamping tabs.

8. The T-clip of claim 2, wherein said base includes six barbs.

9. The T-clip of claim 2, wherein said clamping tab includes five barbs.

10. The T-clip of claim 2, wherein said arm includes an outwardly extending wing capable of assisting in mounting to the vertical member.

11. The T-clip of claim 10, wherein said wing is angled away from said base to accommodate build variation.

12. The T-clip of claim 10, wherein said wing is angled away from said base to accommodate warped joists.

13. A clip for connecting a deck board to a joist, the clip comprising:

a base configured to engage a planar surface of the deck board;

at least one attachment feature attached to said base, said attachment feature capable of securing said base to said deck board;

a plurality of barbs attached to said base, said barbs configured to engage said joist to said base by piercing said joist;

a pair of arms extending from said base at acute angles relative to said base;

a first clamping tab extending at an angle from one of said pair of arms and a second clamping tab extending at an angle from said other of said pair of arms, said first and second clamping tabs capable of clamping said joist between said first and second clamping tabs, wherein said first and second clamping tabs are generally perpendicular to said base;

a plurality of tab barbs attached to said first and second clamping tabs, said tab barbs capable of engaging said joist; and wings extending outwardly from each of said pair of arms.

14. The clip of claim 13, wherein said tab barbs are angled toward said base whereby said joist enters between said first and second clamping tabs toward said base without said tab barbs engaging said joist.

15. The clip of claim 14, wherein said tab barbs engage said joist when said joist is between said first and second clamping tabs and is moved away from said base.

16. The clip of claim 13, wherein said wings assist with positioning said joist between said first and second clamping tabs.

17. A clip for connecting a deck board to a joist, the clip comprising:

a base defining an inner surface and an outer surface, said base configured to engage a planar surface of the deck board;

at least one attachment feature attached to said base, said attachment feature capable of securing said base to an underside of said deck board;

a plurality of barbs attached to said inner surface of said base, said barbs configured to be driven into and pierce a top surface of said joist;

a pair of arms extending at an acute an from said inner surface of said base;

clamping tabs extending at an angle from each of one of said pair of arms, said clamping tabs generally perpendicular to said base and spaced apart to accept and clamp said joist; and wherein said clamping tabs each include a plurality of tab barbs angled toward said base wherein said joist enters between said clamping tabs toward said base without said tab barbs engaging said joist.

18. The clip of claim 17, wherein said tab barbs engage said joist when said joist is between said clamping tabs and is moved away from said base.

19. The clip of claim 17, further comprising wings extending outwardly from each of said pair of arms, wherein said wings assists with positioning said joist between said clamping tabs.

20. The clip of claim 17 wherein said attachment feature comprises a pair of tabs integrally formed with said base and an aperture in each of said tabs wherein said aperture is sized to receive a fastener.

* * * * *